United States Patent [19]

Brownawell et al.

[11] 4,388,201

[45] Jun. 14, 1983

[54] CO-DISPERSANT STABILIZED FRICTION MODIFIER LUBRICATING OIL COMPOSITION

[75] Inventors: Darrell W. Brownawell, Scotch Plains; Harold Shaub, Berkeley Heights; Max J. Wisotsky, Highland Park; Antonio Gutierrez, Mercerville, all of N.J.

[73] Assignee: Exxon Research & Engineering Co., Florham Park, N.J.

[21] Appl. No.: 284,739

[22] Filed: Jul. 20, 1981

[51] Int. Cl.[3] ..... C10M 1/20; C10M 1/26; C10M 1/32; C10M 1/54

[52] U.S. Cl. ..... 252/49.6; 252/51.5 A; 252/51.5 R; 252/56 R

[58] Field of Search ..... 252/32.7 E, 49.6, 51.5 A, 252/51.5 R, 56 R

[56] References Cited

U.S. PATENT DOCUMENTS

| | | | |
|---|---|---|---|
| 3,933,659 | 1/1976 | Lyle et al. | 252/32.7 E |
| 4,062,786 | 12/1977 | Brois et al. | 252/51.5 R |
| 4,105,571 | 8/1978 | Shaub et al. | 252/32.7 E |
| 4,113,639 | 9/1978 | Lonstrup et al. | 252/51.5 A |
| 4,116,876 | 9/1978 | Brois et al. | 252/49.6 |
| 4,169,836 | 10/1979 | Ryer et al. | 546/238 |

*Primary Examiner*—W. J. Shine

*Attorney, Agent, or Firm*—J. J. Mahon

[57] ABSTRACT

Lubricating oil compositions which contain polycarboxylic acid-glycol esters as friction modifiers in combination with hydrocarbon soluble borated or non-borated alkenyl succinimide dispersant and especially those also containing metal additives are stabilized against tendency of such components to form sediment upon storage through addition of small proportions of a co-dispersant being an oil-soluble hydrocarbyl substituted mono or bis-oxazoline or lactone oxazoline.

9 Claims, No Drawings

CO-DISPERSANT STABILIZED FRICTION MODIFIER LUBRICATING OIL COMPOSITION

This invention relates to storage stable lubricating oil composition containing an additive package which provides both dispersant and friction modification properties. More particularly, this invention relates to a formulated lubricating oil composition containing a polycarboxylic acid-glycol ester friction modifier and an alkenyl succinimide dispersant or borated derivative thereof having a reduced tendency to form sediment deposit upon storage Lubricating oil compositions which contain dimer acid esters as friction reducing components are known in the art and are disclosed, for example, in U.S. Pat. No. 4,105,571, issued Aug. 8, 1978 to Shaub et al. The oil-soluble alkenyl succinimide dispersants, particularly polyisobutenyl succinimide disperants, are wellknown and are disclosed in U.S. Pat. No. 3,172,892 issued Mar. 9, 1965 to LeSuer et al. and U.S. Pat. No. 3,933,659 issued Jan. 20, 1976 to Lyle et al.

It is known that lubricating oil compositions containing the aforesaid borated or non-borated alkenyl succinimide dispersants and polycarboxylic acid-glycol ester friction modifiers offer a number of advantageous properties. However, a problem encountered upon storage of these formulations is the tendency of sediment formation upon storage, especially in the presence of metal containing detergent additives and anti-wear additives. The present invention deals with this problem by providing a co-dispersant found effective in stabilizing such compositions against sediment formation, the co-dispersant being an oil soluble mono- or bis-oxazoline or hydrocarbyl substituted lactone oxazoline, as well as offering the additional advantage of enhanced sludge dispersant and varnish inhibition properties.

Shaub et al. in U.S. Pat. No. 4,105,571 disclose that incompatibility problems in connection with the combined use of zinc dialkyl dithiophosphates and glycol ester friction reducing components can be resolved by pre-dispersing either of these components in an ashless dispersant prior to their inclusion in the finished formulation. The present invention is an alternative resolution to this problem by providing particular co-dispersants to be used in combination with an alkenyl succinimide dispersant or a borated alkenyl succinimide dispersant.

In accordance with the present invention there are provided storage stable lubricating oil compositions having a reduced tendency to form sediment comprising a major portion of lubricating oil containing:

(a) a polycarboxylic acid-glycol ester friction reducing component;

(b) an oil-soluble borated or non-borated alkenyl succinimide dispersant, and (c) an oil-soluble co-dispersant in an amount effective to reduce the formation of sediment, said co-dispersant being a hydrocarbyl substituted mono- or bis-oxazoline or hydrocarbyl substituted lactone oxazoline.

The term lubricating oil composition as used herein is meant to refer to fully formulated compositions intended for use, such as crankcase motor oils, which contain a major portion of lubricating oil and a number of conventionally used additives in typical amounts to provide their normal attendant functions, especially oxidation inhibitors, rust inhibitors, viscosity index improvers, e.g. olefin copolymers, pour point depressants, and metal-containing detergent additives, such as the neutral and basic metal phenates, sulfurized phenates and sulfonates with calcium and magnesium being customarily used, as well as the zinc dialkyl dithiophosphates, which are known to be effective anti-oxidant and anti-wear additives. It is believed that the metal-containing additives noted above contribute to the tendency of lubricating oil formulations to form sediment when used in the presence of the ester friction reducing component and borated or non-borated alkenyl succinimide dispersant. The metal phenates, sulfurized phenates and sulfonates are typically present in amounts of from about 2 to 5 weight percent and metal, e.g., zinc. dialkyl dithiophosphates, are usually found in fully formulated lubricating oil compositions in amounts from about 1 to 3 weight percent.

The friction reducing esters are generally derived from the esterification of a polycarboxylic acid with a glycol and may be partial esters or diesters of the formulas:

HO—R′—OOC—R—COOH and
HO—R′—OOC—R—COOR″—OH where R is the hydrocarbon radical of the acid and R′ and R″ is either the hydrocarbon radical of an alkane diol or the oxyalkylene radical from an oxa-alkane diol as defined hereinbelow. The polycarboxylic acid may be an aliphatic saturated or unsaturated acid and will generally have a total of about 24 to 90, preferably about 24 to 60 carbon atoms and about 2 to 3, preferably about 2 carboxylic acid groups with at least about 9 carbon atoms, preferably about 12 to 42, especially 16 to 22 carbon atoms between the carboxylic acid groups. Generally about 1–3 moles of glycol, preferably 1–2 moles of glycol, is used per mole of acid to provide either a complete or partial ester.

Also, esters can be obtained by esterifying a dicarboxylic acid or mixture of such acids with a diol or mixture of diols, R would then be the hydrocarbon radical of the dicarboxylic acid and R′ and R″ would be the hydrocarbon radical associated with the diol or diols.

The friction reducing esters are typically used in amounts ranging from about 0.01 percent to 2 percent by weight, preferably 0.05 to 0.5 percent by weight, based upon the overall weight of the lubricating oil composition, more preferably, formulations containing 0.1 to 0.3 weight percent are highly effective.

Especially preferred are the dimer acid ester friction reducing esters. The term dimer acid used herein is meant to refer to those substituted cyclohexene dicarboxylic acids formed by a Diels-Alder-type reaction which is a thermal condensation of $C_8$–$C_{22}$ unsaturated fatty acids, such as tall oil fatty acids, which typically contain about 85 to 90 percent oleic or linoleic acids. Such dimer acids typically contain about 36 carbon atoms. The dimer acid structure can be generalized as follows:

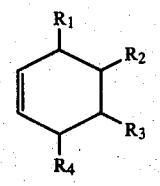

with two of the R groups being carboxyl groups and two being hydrocarbon groups depending upon how the condensation of the carboxylic acid has occurred. The carboxyl groups can be $—(CH_2)_8COOH$-;$—CH{=}CH(CH_2)_8COOH$;$—(CH_2)_7COOH$;$—CH_2—CH{=}CH(CH_2)_7COOH$;$—CH{=}CH(CH_2)_7COOH$ and the hydrocarbon terminating group can be represented by: $CH_3(CH_2)_4—$;$CH_3(CH_2)_5—$;$CH_3(CH_2)_7—$;$CH_3(CH_2)_4CH{=}CH—$; $CH_3(CH_2)_4CH{=}CH CH_2—$; and the like. The dimer of linoleic acid which is the preferred embodiment can be expressed in the following formula;

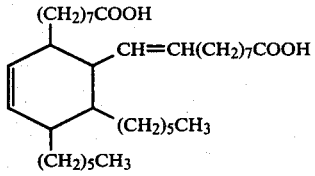

Also the term dimer acid is used herein necessarily includes products containing up to about 24 percent by weight trimer, but more typically about 10 percent by weight trimer since it is well known in the art, the dimerization reaction provides a product containing a trimer acid having molecular weight of about three times the molecular weight of the starting fatty acid.

The polycarboxylic acids or dimer acids noted above are esterified with a glycol, the glycol being an alkane diol or oxa-alkane diol, represented by the formula $HO(RCHCH_2O)_xH$ wherein R is H or $CH_3$ and x is about 2 to 100, preferably 2 to 25, with ethylene glycol and diethylene glycol particularly preferred. A preferred embodiment is formation of the ester with about 1–2 moles of glycol per mole of dimer acid, such as the ester of diethylene glycol with dimerized linoleic acid.

These friction modifier ester components are customarily used in amounts ranging from about 0.01 to 1 weight percent based upon the overall weight of the formulated lubricating oil composition and preferably in the range of about 0.05 to 0.3 weight percent, such as 0.1 to 0.2 weight percent. It has been found in accordance with the present invention that substantially complete sediment elimination will be obtained when the friction reducing ester component is present in amounts up to about 0.3 weight percent and for amounts of friction modifier in excess of about 0.3 weight percent there will be a substantial reduction of sediment formation when using the co-dispersant of the present invention. Preferred composition of the present invention are therefore those having 0.05 to 0.3 weight percent friction reducing polycarboxylic acid-glycol ester.

The oil soluble alkenyl succinimide ashless dispersants are those formed by reacting a polyalkenyl succinic acid or anhydride with an alkylene polyamine. Preferably, the alkenyl group is derived from a polymer of a $C_2$ to $C_5$ mono-olefin, especially a polyisobutylene, where the polyisobutenyl group has a number average molecular weight of about 700 to about 5,000, more preferably, 900 to 1,500. Suitable alkylene polyamines are represented by the formula $NH_2(CH_2)_n—(NH(CH_2)_n)_m—NH_2$ wherein n is 2 to 3 and m is 0 to 10. Illustrative are ethylene diamine, diethylene triamine, triethylene tetraamine, tetraethylene pentamine, which is preferred, pentaethylene haxamine and the like. These are reacted with the alkenyl succinic acid or anhydride in ratios of about 1:1 to 10:1 moles of alkenyl succinic acid or anhydride to polyamine.

The borated alkenyl succinimide dispersants are also well known in the art as disclosed in U.S. Pat. No. 3,254,025. These derivatives are provided by treating the alkenyl succinimide as described above with a boron compound selected from the group consisting of boron oxides, boron halides, boron acids and esters thereof, in an amount to provide from about 0.1 atomic proportion of boron to about 10 atomic proportions of boron for each atomic proportion of nitrogen in the dispersant. The borated product will generally contain about 0.1 to 2.0, preferably 0.2 to 0.8, weight percent boron based upon the total weight of the borated dispersant. Boron is considered to be present as dehydrated boric acid polymers attaching as the metaborate salt of the imide. The boration reaction is readily carried out adding from about 1 to 3 weight percent based on the weight of dispersant, of said boron compound, preferably boric acid, to the dispersant as a slurry in mineral oil and heating with stirring from about 135° to 165° C. for about 1 to 5 hours followed by nitrogen stripping and filtration of the product.

These alkenyl succinimide or borated alkenyl succinimide ashless dispersants are used customarily in lubricating oil compositions in amounts ranging from 0.1 to 10 percent, preferably 0.5 to 5 percent by weight based upon the total weight of the finished composition. The oxazoline and lactone oxazoline co-dispersant as described in more detail herein below are employed in amounts of from about 10 percent to 90 percent by weight based on the weight of borated or non-borated alkenyl succinimide, preferably in the range of 25 percent to 75 percent by weight.

The co-dispersants useful in the present invention are the same as those oil-soluble hydrocarbyl substituted mono- and bis- oxazolines and lactone oxazolines as described in U.S. Pat. No. 4,116,876 issued Sept. 26, 1978 to Brois et al., U.S. Pat. No. 4,169,836 issued Oct. 2, 1979 to Ryer et al. and U.S. Pat. No. 4,062,786 issued Dec. 13, 1977 to Brois et al.

The mono- and bis- oxazoline co-dispersants are prepared by reaction of a $C_4$–$C_8$ amino alcohol of the formula $NH_2—C(X)_2—CH_2OH$ wherein X is alkyl or hydroxyalkyl, at least one X being the hydroxyalkyl of the formula $—(CH_2)_mOH$, m being 1 to 3 with an oil-soluble hydrocarbon substituted $C_4$–$C_{10}$ dicarboxylic acid material (acid, anhydride, or ester), the hydrocarbon substituent having a C average based upon the Mn of at least about 50 carbon atoms and preferably being a polymeric alkenyl group derived from a $C_2$–$C_5$ mono-olefin, e.g., ethylene, propylene, butylene, isobutylene, and pentene with polyisobutenyl being preferred herein. Examples of suitable amino-alkanols are 2-amino-2-methyl-1,3 propanediol, tris-(hydroxymethyl) aminomethane, a preferred amino-alcohol, also referred to as THAM, 2-amino-2-ethyl, 1–3 propanediol and similar disubstituted amino alcohols capable of forming the oxazoline ring in reaction with the oil-soluble hydrocarbon substituted dicarboxylic acid material.

The mono-oxazoline is formed by reaction of equivalent proportions of amino-alkanol and dicarboxylic acid material. The bis-oxazoline is formed by reaction of 2 moles of aminoalkanol per mole of dicarboxylic acid material at about 140°–240° C. for about 0.5 to 24 hours with or without an inert diluent.

Preferred dicarboxylic acid materials are polyisobutenyl succinic anhydrides wherein the polyisobutenyl group has an Mn of 700 to 140,000, more usually 900 to 10,000, and especially, 1,200 to 5,000, with one terminal bond per polymer chain.

Other suitable but less preferred dicarboxylic acid materials are those derived from $C_4$–$C_{10}$ dicarboxylic acid materials, such as, formic acid, itaconic acid, chloromaleic acid, dimethyl fumarate and the like.

An oxazoline product is considered represented by the following structure showing a bis-oxazoline:

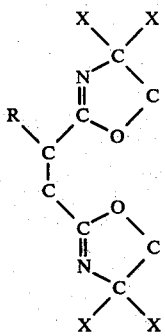

wherein R is hydrocarbyl group, such as a polyisobutenyl group, and X would be, for example, a —$CH_2OH$ if THAM were the aminoalkanol used. Lactone oxazoline co-dispersants useful in the present invention are described in U.S. Pat. No. 4,062,786 issued Dec. 13, 1977 to Brois et al and are the reaction products of hydrocarbyl substituted lactone carboxylic acids with the above described 2,2-disubstituted-2-amino-1-alkanols.

The preferred lactone oxazoline co-dispersant is the reaction product of polyisobutenyl lactone carboxylic acid with tris-(hydroxymethyl) amino-methane at a temperature of from about 100°–240° C., preferably 150°–180° C., until two moles of $H_2O$ per mole of reactant is removed from the reaction.

Generally, the lactone oxazoline co-dispersant is formed by lactonization, an intramolecular cyclization, in the presence of an acid catalyst, such as a mineral acid, a Lewis acid, or an alkanesulfonic acid, of a hydrocarbyl substituted dicarboxylic acid material (acid, anhydride, or ester), such as an alkenyl succinic acid analog obtained via the Ene reaction of an olefin with an alpha-beta unsaturated $C_4$–$C_{10}$ dicarboxylic acid, anhydride or ester such as fumaric acid, itaconic acid, maleic acid, maleic anhydride, dimethyl fumarate, and the like. The olefin source for the hydrocarbyl substituted comprise the same materials described hereinabove for the mono- and bis-oxazoline co-dispersants use in the present invention, i.e., $C_2$–$C_5$ monoolefin polymers, especially polyisobutenyl polymers.

The lactone oxazoline co-dispersant is formed by heating together the hydrocarbon substituted lactone dicarboxylic acid material noted above with the 2,2-disubstituted-2-amino-1-alkanol, preferably THAM, in at least equivalent amounts.

An example of a lactone oxazoline co-dispersant produced thereby is considered to have the following structure where the dicarboxylic acid material is a lactonized polyisobutenyl succinic anhydride and THAM is the amino-alkanol used:

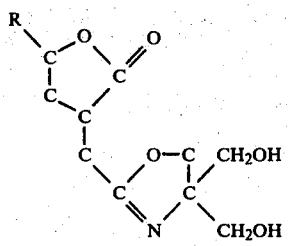

where the R represents the polyisobutenyl moiety.

The lubricating oil base stock employed herein are those customarily used. The term lubricating oil includes not only the petroleum hydrocarbon paraffinic, naphthenic, and aromatic oils of lubricating viscosity, but also synthetic oils, such as polyethylene oils, esters of dicarboxylic acids, complex ester oils, polyglycol, and alcohol alkyl esters of carbonic or phosphoric acids, polysilicones, flurohydrocarbon oils and the like. Preferred base stocks are mineral hydrocarbon oils of a paraffinic nature, especially those having a viscosity of about 20 to 100 cS min. (100° F.), and blends of such mineral paraffinic oils.

While the method of addition of the dispersant and co-dispersant of the present invention is largely a function of the exact composition of the fully formulated composition, it is generally preferable to provide a blend of ester component, dispersant and co-dispersant by admixing same at a moderately elevated temperature no greater than about 150° F. and incorporating this three-component blend into the lubricating oil composition either prior to or subsequent to the addition of other additives.

EXAMPLES

A lubricating oil formulation was prepared containing the dimer acid ester friction modifier and an alkenyl succinimide dispersant to which were added to to co-dispersant in accordance with the present invention.

The initial formulation was a storage-stable standard 10W-40 SE quality automotive lubricating oil compositing containing a zinc dialkyl dithiophosphate, overbased metal sulfonate, rust inhibitor, and VI improver in typical proportions. To this was added 0.1 percent by weight of a friction modifier being the ester of a dimerized linoleic acid and diethylene glycol and 5 weight percent of the reaction product of 2.1 moles polyisobutenyl (Mn=1300) succinic anhydride (Sap. No. 103) and 1 mole of alkylene polyamine to provide the Base Formulation of the Examples. The polyamine had a composition approximating tetraethylene pentamine and is available commercially under the trade name "DOW E-100" from Dow Chemical Company, Midland, Mich. Samples (100 ml., in calibrated test tubes) of this Base Formulation were centrifuged for 8, 16, and 24 hours at 1900 r.p.m. at room temperature and thereafter, samples to which were added the co-dispersants of the present invention were also tested for compatibility by centrifuging under the same conditions. The volume percent sediment was measured for each sample by noting the level of sediment on the calibrated test tubes and the results are set forth in the following Table I. The term "Trace" refers to samples having less than 0.05 ml. observable sediment which is considered a stable composition. All lubricating oil formulations will show a "trace".

TABLE I

| Formulation | Vol. % After Centrifuging 8 hrs. | 16 hrs. | 24 hrs. |
|---|---|---|---|
| Base | .20 | .50 | 3.00 |
| Base + Co-Dispersant (1) | Trace | Trace | Trace |
| Base + Co-Dispersant (2) | Trace | Trace | Trace |
| Base + Co-Dispersant (3) | Trace | Trace | Trace |
| Base + Co-Dispersant (4) | Trace | Trace | Trace |

(1) Polyisobutenyl succinic anhydride-monooxazoline prepared by reacting equimolar proportions of polyisobutenyl succinic anhydride (Mn = 960) and tris(hydroxymethyl) aminomethane in Solvent 150 Neutral paraffinic mineral oil at 200° C.; 2.5 weight percent was used based on total weight of the formulation.

(2) 2.5 weight percent of a bis-oxazoline formed by condensing 1 mole of polyisobutenyl succinic anhydride of Mn = 1300 with 1.9 moles of THAM.

(3) 2.5 weight percent of a lactone oxazoline formed by first lactonizing a polyisobutenyl succinic anhydride of Mn = 960 and Sap. No. 92 with $H_2SO_4$ for 3 hours at 105° C. and thereafter, reacting with an equimolar quantity of THAM at 180° C. for about 4 hours; the procedure being fully disclosed in U.S. Pat. No. 4,062,786.

(4) Formulation (3) was repeated with equivalent results except that the Base Formulation was modified by employing 0.3 weight percent of the friction modifier ester and 1.25 weight percent of the same polyisobutenyl lactone oxazoline co-dispersant was used.

What is claimed is:

1. A storage stable lubricating oil composition having a reduced tendency to form sediment comprising a major portion of lubricating oil containing:

(a) 0.05 to 0.3 weight percent of a polycarboxylic acid-glycol ester friction modifier;

(b) 0.5 to 5.0 weight percent of a polyalkenyl succinimide or borated polyalkenyl succinimide dispersant and;

(c) a sediment reducing amount of a co-dispersant being an oil-soluble hydrocarbyl substituted mono- or bis-oxazoline or a hydrocarbyl substituted lactone oxazoline, said co-dispersant being present in an amount of from 25 to 75 weight percent of said (b) component dispersant and (d) metal containing additives which contribute to the tendency of the formulation to form sediment, the metal containing additives being (i) a neutral or basic phenate, sulfurized phenate or sulfonate detergent additive, present in an amount of from about 2 to 5 weight percent and (ii) a zinc dialkyl dithiophosphate antiwear additive present in an amount of from about 1 to 3 weight percent.

2. The composition of claim 1 wherein the friction modifier ester is a diethylene glycol ester of dimerized linoleic acid.

3. The composition of claim 2 wherein the (b) component is a polyalkenyl succinimide dispersant being the reaction product of polyisobutenyl succinic anhydride and an alkylene polyamine of the formula $NH_2(CH_2)_n—(NH(CH_2)_n)_m—NH_2$ wherein n is 2 to 3 and m is 0 to 10.

4. The composition of claim 3 wherein the (b) component dispersant is a borated dispersant.

5. The composition of claim 3 or 4 wherein said co-dispersant is a mono- or bis-oxazoline being the reaction product of a polyisobutenyl succinic anhydride with a $C_4$–$C_8$ amino alcohol of the formula $NH_2—C(X)_2—CH_2OH$ where X is alkyl or hydroxyalkyl, at least one X being hydroxyalkyl of the formula $—(CH_2)_mOH$, m being 1–3.

6. The composition of claim 5 wherein the co-dispersant is a mono-oxazoline and the amino-alcohol is tris-(hydroxymethyl)aminomethane.

7. The composition of claim 5 wherein the co-dispersant is a bis-oxazoline and the amino-alcohol is tris-(hydroxymethyl)aminomethane.

8. The composition of claim 1 wherein the co-dispersant is a lactone oxazoline formed by the reaction of a lactonized polyisobutenyl succinic anhydride with at least equimolar proportions of a $C_4$–$C_8$ amino-alcohol of the formula $NH_2—C(X)_2—CH_2OH$ wherein X is alkyl or hydroxyalkyl, at least one X being hydroxyalkyl of the formula $—(CH_2)_mOH$, m being 1–3.

9. The composition of claim 7 wherein the amino-alcohol is tris-(hydroxymethyl)aminomethane.

* * * * *